US008309831B2

(12) United States Patent
Timm

(10) Patent No.: US 8,309,831 B2
(45) Date of Patent: Nov. 13, 2012

(54) MUSIC BOX WITH INTERCHANGEABLE ELECTRONIC MOVEMENT

(75) Inventor: Mark Timm, Bainbridge, IN (US)

(73) Assignee: Cottage Garden, Inc., Bainbridge, IN (US)

( * ) Notice: Subject to any disclaimer, the term of this patent is extended or adjusted under 35 U.S.C. 154(b) by 0 days.

(21) Appl. No.: 13/367,477

(22) Filed: Feb. 7, 2012

(65) Prior Publication Data

US 2012/0204701 A1 Aug. 16, 2012

Related U.S. Application Data

(60) Provisional application No. 61/440,137, filed on Feb. 7, 2011.

(51) Int. Cl.
*G10F 1/06* (2006.01)

(52) U.S. Cl. ..... 84/95.1

(58) Field of Classification Search ..... 84/95.1, 84/95.2, 94.1, 94.2, 107, 110, 112–116, 128, 84/137, 147–160
See application file for complete search history.

(56) References Cited

U.S. PATENT DOCUMENTS

| | | | | |
|---|---|---|---|---|
| 4,090,349 | A | 5/1978 | Takase | |
| 5,567,892 | A | 10/1996 | Huang | |
| 6,313,386 | B1 * | 11/2001 | Capobianco et al. | 84/600 |
| 6,538,186 | B1 | 3/2003 | Huang | |
| 6,862,824 | B1 | 3/2005 | Hermanson et al. | |
| 6,915,604 | B2 | 7/2005 | Haywood | |
| 6,960,710 | B2 | 11/2005 | Segan et al. | |

* cited by examiner

*Primary Examiner* — Kimberly Lockett
(74) *Attorney, Agent, or Firm* — Bose McKinney & Evans LLP

(57) ABSTRACT

A music box having an easily removable electronic movement. The easily interchangeable nature of the movement allows consumers to easily combine a desired music box configuration with an electronic movement that plays a desired musical tune. It also allows a consumer to purchase multiple movements to thereby allow the consumer to periodically change the musical tune played by the music box.

16 Claims, 4 Drawing Sheets

Fig. 1
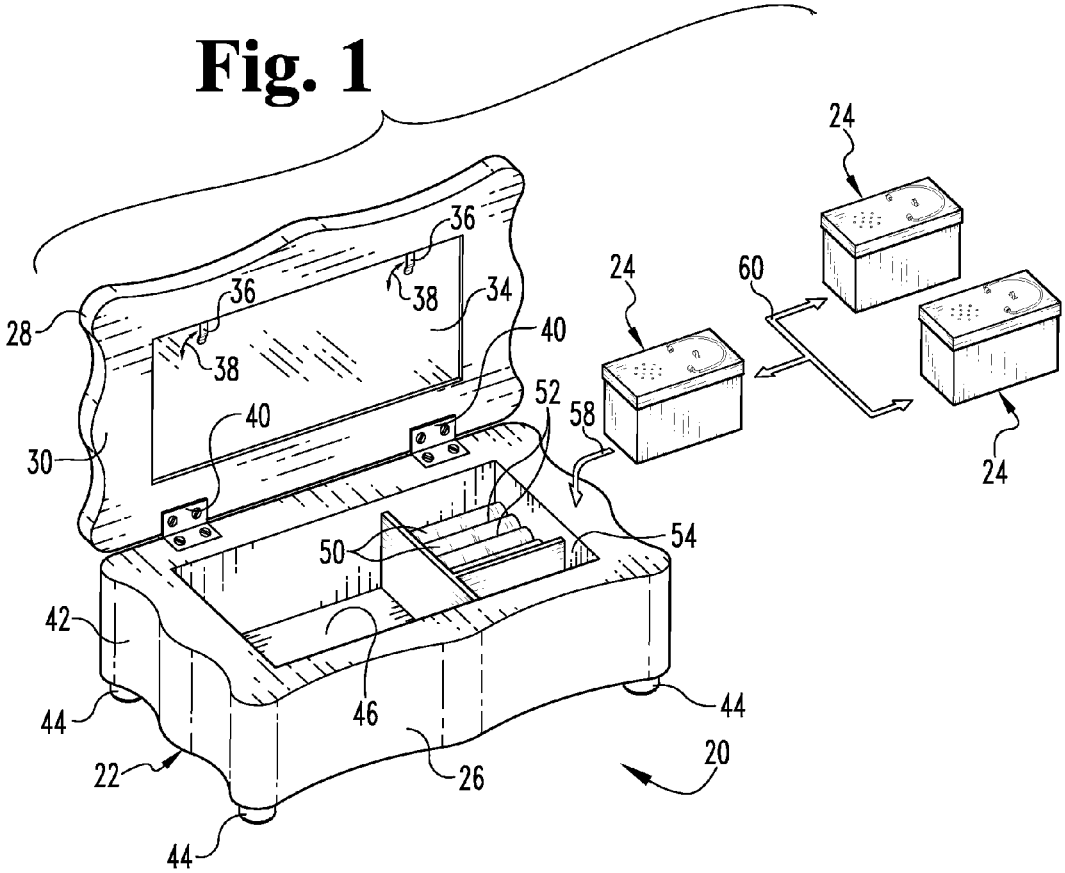
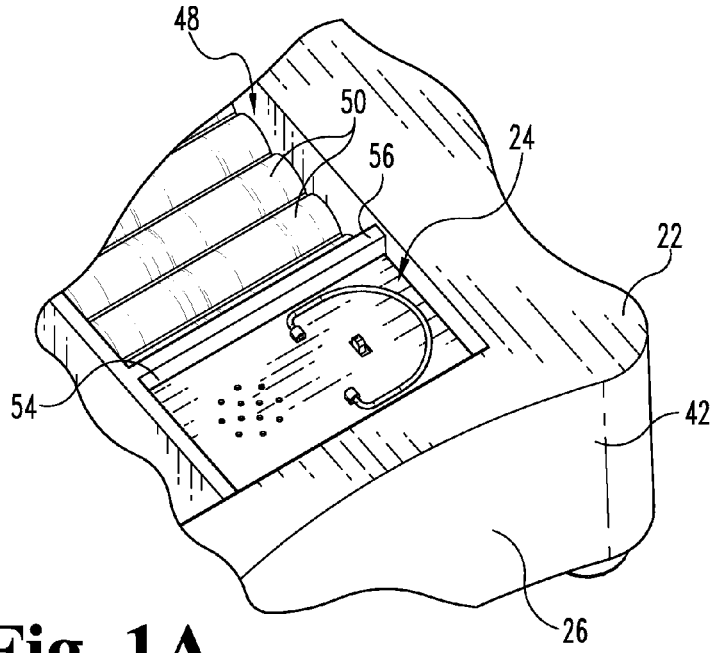
Fig. 1A

MUSIC BOX WITH INTERCHANGEABLE ELECTRONIC MOVEMENT

CROSS REFERENCE TO RELATED APPLICATIONS

This application claims priority under 35 U.S.C. 119(e) of U.S. provisional patent application Ser. No. 61/440,137 filed on Feb. 7, 2011 entitled MUSIC BOX WITH INTERCHANGEABLE ELECTRONIC MOVEMENT the disclosure of which is hereby incorporated herein by reference.

BACKGROUND OF THE INVENTION

1. Field of the Invention

The present invention relates to small music boxes suitable for holding jewelry and other similar items.

2. Description of the Related Art

A wide variety of small music boxes are known. For example, music boxes having complex mechanical movements for generating music are well-known in the art. It is also known to provide a music box with a small storage space for holding jewelry and other small items. The use of electronic circuits with music boxes is also known in the art.

SUMMARY OF THE INVENTION

The present invention provides an improved music box having an interchangeable electronic sound generating unit or movement whereby a movement within the music box can be easily removed and replaced by another movement to thereby change the tune played by the music box.

The invention comprises, in one form thereof, a music box system that includes a main body defining at least one compartment and a lid operably secured to the main body and moveable between a closed position limiting access to the compartment and an open position permitting access to the compartment. A movement having a housing is removeably positionable within the compartment. The movement includes control circuitry that is operably coupled with a power source, a speaker and data storage circuitry. The data storage circuitry is adapted to store audio data and the control circuitry is adapted to operate the speaker to play the audio data. The movement also includes a switch operably coupled with the control circuitry wherein the switch is operable to selective activate and deactivate the movement. A photodetector is also operably coupled with the control circuitry wherein the control circuitry causes the speaker to play the audio data when the movement is activated and the photodetector detects light above a threshold value.

The invention comprises, in another form thereof, a music box system that includes a main body defining at least one compartment and a lid operably coupled with the main body and moveable between a closed position limiting access to the compartment and an open position permitting access to the compartment. The music box system also includes a plurality of movements selectively and exchangably positionable within the compartment. Each of the movements has a housing and includes control circuitry that is operably coupled with a power source, a speaker and data storage circuitry. The data storage circuitry is adapted to store audio data and the control circuitry is adapted to operate the speaker to play the audio data. Each of the movements also includes a switch operably coupled with the control circuitry wherein the switch is operable to selective activate and deactivate the movement and a photodetector operably coupled with the control circuitry. The control circuitry causes the speaker to play the audio data when the movement is activated and the photodetector detects light above a threshold value.

The invention comprises, in yet another form thereof, a music box system that includes a main body defining a plurality of compartments and a lid pivotally secured to the main body and moveable between a closed position limiting the entry of light and access to the compartments and an open position permitting access to the compartments. The music box system also includes a movement having control circuitry that is operably coupled with a power source, a speaker and data storage circuitry. The data storage circuitry is adapted to store audio data and the control circuitry is adapted to operate the speaker to play the audio data. The movement also includes a switch operably coupled with the control circuitry wherein the switch is operable to selective activate and deactivate the movement. A photodetector is operably coupled with the control circuitry wherein the control circuitry causes the speaker to play the audio data when the movement is activated and the photodetector detects light above a threshold value. A movement housing supports the control circuitry, power source, speaker and data storage circuitry, photo detector and switch. The housing is removably positionable within one of the plurality of compartments and includes a pivotal handle to facilitate removal of the housing from the one compartment.

In some embodiments, the photodetector, switch and handle are all exposed when the housing is disposed in the one compartment and the lid is in the open position. The housing may also define a plurality of openings with the speaker being mounted opposite the openings such that the speaker openings are also exposed when the housing is disposed in the one compartment with the lid in the open position. The power source may take the form of at least one battery with the housing having a removable cover wherein removal of the cover permits access to the battery.

BRIEF DESCRIPTION OF THE DRAWINGS

The above mentioned and other features of this invention, and the manner of attaining them, will become more apparent and the invention itself will be better understood by reference to the following description of an embodiment of the invention taken in conjunction with the accompanying drawings, wherein:

FIG. 1 is an exploded perspective view of a music box system in accordance with the present invention.

FIG. 1A is a detail perspective view illustrating an interchangeable movement positioned in a music box.

Figure 4:
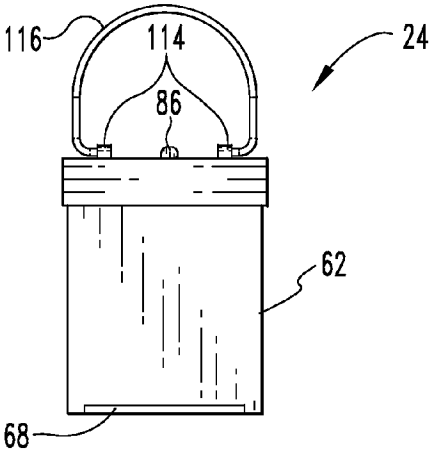
FIG. 4 is another end view of the interchangeable movement.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DETAILED DESCRIPTION OF THE INVENTION

A music box system 20 in accordance with the present invention is depicted in FIG. 1. The system 20 includes a music box 22 and a plurality of interchangeable movements 24. In the illustrated embodiment the music box 22 includes a main body 26 and a hinged lid 28.

In the illustrated embodiment, the lid 28 includes a rigid outer perimeter 30 which defines a central opening 32 in which a piece of glass or clear plastic (not shown) is mounted. The clear glass forms a part of the upper surface of lid 28, when lid 28 is closed. A photograph or other graphical element is placed below the glass and held in place by backing member 34. Backing member 34 includes two pivotal brackets 36 which allow the backing member 34 to be removed and resecured to lid 28 to thereby allow the photo under the glass to be replaced or periodically exchanged with one or more other photos or graphical images. Arrows 38 indicate the pivotal movement of brackets 36. In the illustrated embodiment, the exposed surface of backing member 34 is covered in black velvet. Similarly, the surface of rigid perimeter 30 which faces main body 26 when lid 28 is closed may also be covered in black velvet. The rigid perimeter 30 may advantageously be formed out of wood or have a wood veneer.

Hinged lid 28 is pivotally connected to main body 26 with a pair of metal hinges 40. In the illustrated embodiment, main body 26 includes a container structure 42 having a wood exterior. Four small feet 44 are attached to the bottom of and support container structure 42 at the corners of container structure 42. The interior of container structure 42 is divided into three main compartments which are all lined with black velvet. The main compartment 46 forms the largest storage compartment and can be used to hold jewelry or other items of the user's choice. A second compartment 48 takes the form of a ring holding compartment in the illustrated music box 22. Ring compartment 48 includes a series of parallel extending padding structures 50 defining resiliently deformable slots 52 in which rings or other similar sized items can be held in an organized manner. Such ring-holding structures are well-known to those having ordinary skill in the art.

The third compartment 54 is used to hold movement 24. Movement compartment 54 is shaped to conform to the exterior dimensions of movement 24 to thereby allow movement 24 to be easily placed therein and removed therefrom. FIG. 1 illustrates the music box 22 without a movement 24 located within compartment 54 while FIG. 1A is a detail view showing a movement 24 located within compartment 54.

Sidewalls 56 divide the interior space of main body 26 to form the various compartments thereof and, in the illustrated embodiment, are formed out of rigid panels with a black velvet covering. Each of the compartments, 46, 48 and 54 are also lined with black velvet in the illustrated embodiment.

Although a particular music box 22 has been depicted and described herein, the present invention may be employed with various forms of a music box. For example, alternative embodiments of the music box might include figurines, either stationary or moveable, and the box structure and its surfaces can be formed out of various other materials and take on any number of widely varied shapes and structural configurations.

Arrow 58 in FIG. 1 represents the ability of a movement 24 to be placed in, and removed from, compartment 54 merely by sliding it into or out of compartment 54. Arrow 60 is used to represent the capability of interchanging one of the movements 24 with a different movement 24. In the illustrated embodiment, each of the movements 24 is an electronic movement capable of playing a musical tune. The ability to quickly and easily interchange electronic movements 24 in box 22 provides a number of advantages.

For example, an end user who owned a music box system 20 having a music box 22 and several different electronic movements 24 could own movements 24 which each played a different musical tune. The end user could thereby periodically exchange the movement 24 located in music box 22 for a different movement 24 to thereby provide some variety in the musical tune played when the music box 22 was opened. (The manner in which electronic movement 24 functions is discussed in greater detail below.)

The ability to quickly interchange movements 24 can also be advantageous to the retailer and manufacturer. For example, the retailer can allow the consumer to pick from a variety of different music boxes and also select one or more movements 24, each playing a different musical tune. The consumer can thereby easily select a desired musical box design with a desired musical tune.

The ability to exchange the movements 24 not only allows consumers to easily combine a desired music box design with a desired musical tune, but also allows such consumers to select multiple movements 24 so that if they grow tired of one musical tune, they can exchange it for a movement 24 that plays a different tune. This not only increases the enjoyment of the music box by the consumer but also increases the sales of movements 24 which benefits both the manufacturer and retailer. The "extra" movements 24 purchased by the consumer could be purchased at the same time that that music box was purchased, or, such "extra" movements could be purchased at a later date. For example, a song could be released or become popular only after a consumer bought a particular music box and a movement 24 playing that song could be purchased at a later date by the consumer. As will be recognized from the discussion presented above, various business models become possible and can be employed with music boxes and interchangeable electronic movements 24.

Figure 12:
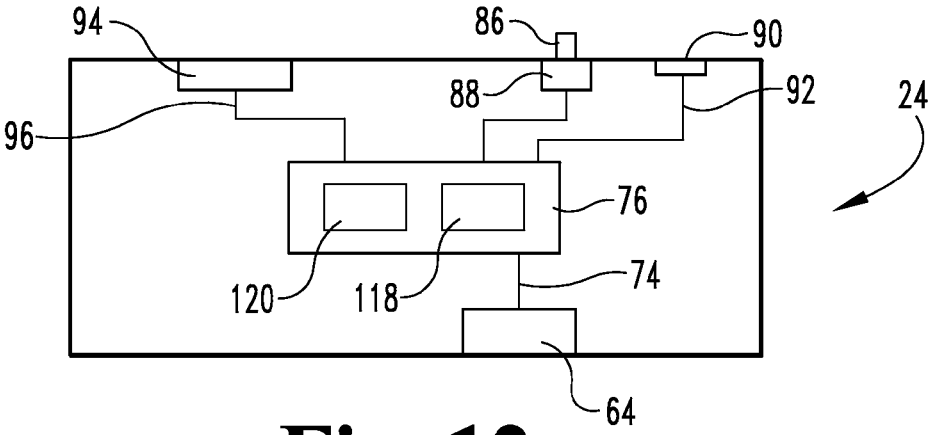
FIG. 12 is a schematic depiction of the interchangeable movement.

The electronic movement 24 will now be discussed in greater detail. The exterior of movement 24 can be seen in FIGS. 2-6. FIGS. 7-11 illustrate the construction of movement 24 while FIG. 12 provides a schematic diagram of movement 24.

Figure 7:
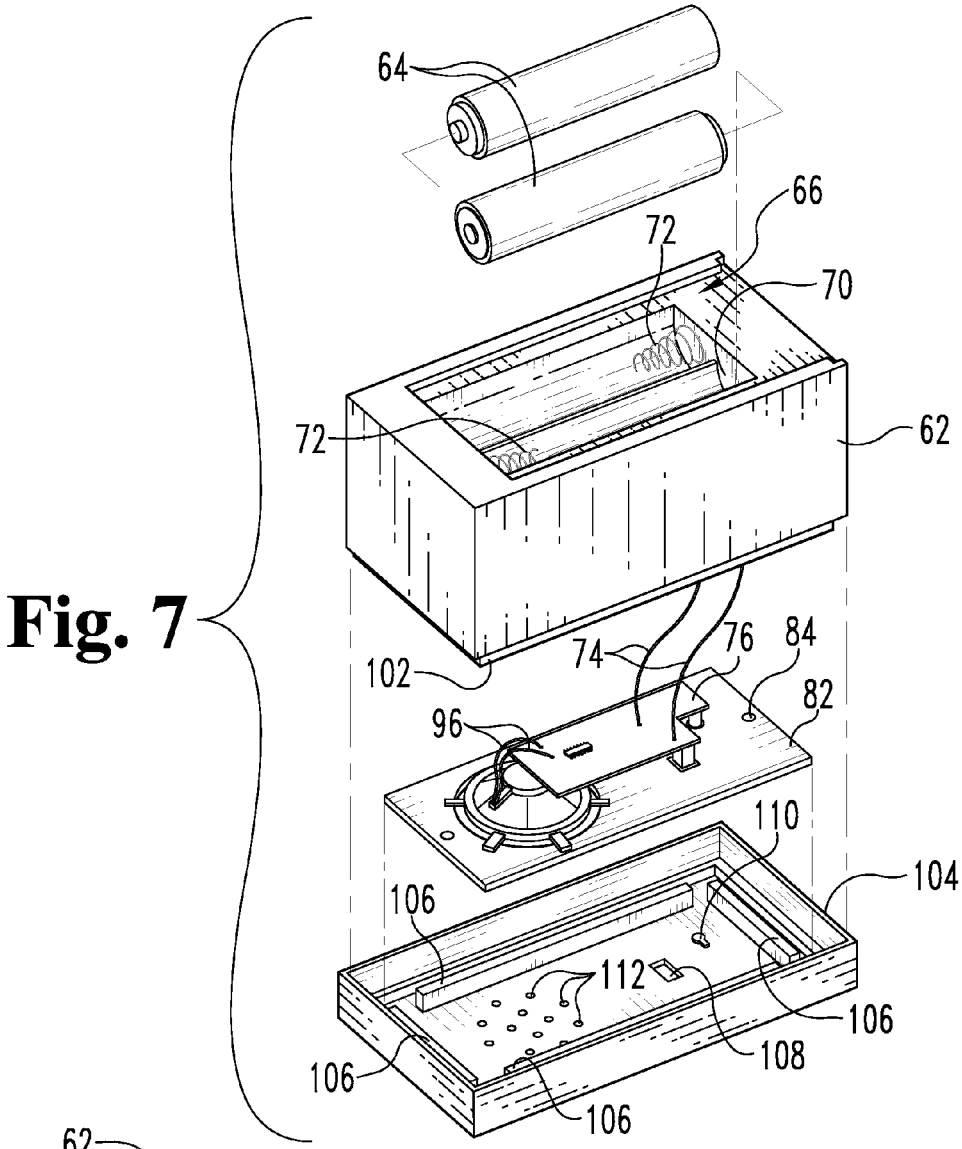
FIG. 7 is an exploded view of the movement.

The movement 24 has a generally rectilinear shape with a lower housing 62 and an upper cap 63. In the illustrated embodiment, lower housing 62 and upper cap 63 are both formed by injection molding a polymeric material. A power source 64 is located within lower housing 62 and, in the illustrated embodiment, takes the form of a pair of AAA batteries (FIG. 7). A battery cavity 66 in lower housing 62 holds the batteries 64 and a slidingly removable cover 68 is used to close the battery cavity 66. Removal of cover 68 provides access to battery cavity 66 and the batteries 64 disposed therein. Metal contact plates 70 and springs 72 are used to conductively engage batteries 64 and wiring 74 communicates electrical power from one of the contact plates 70 to printed circuit board 76 in a manner well-known in the art.

Figure 8:
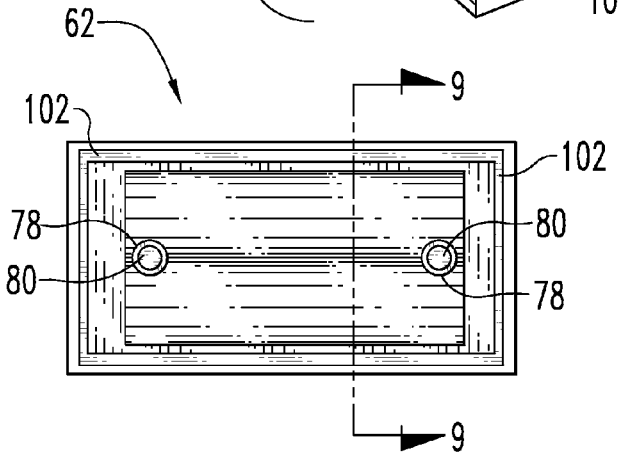
FIG. 8 is a top view of the main housing of the movement.
Figure 9:
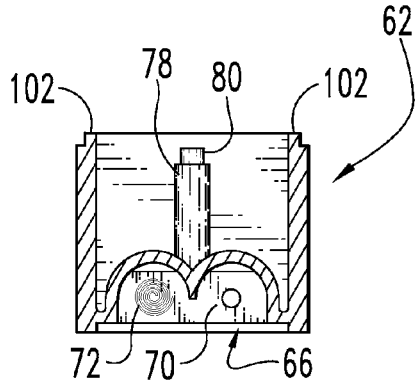
FIG. 9 is a cross sectional view taken along line 9-9 of FIG. 8.
Figure 10:
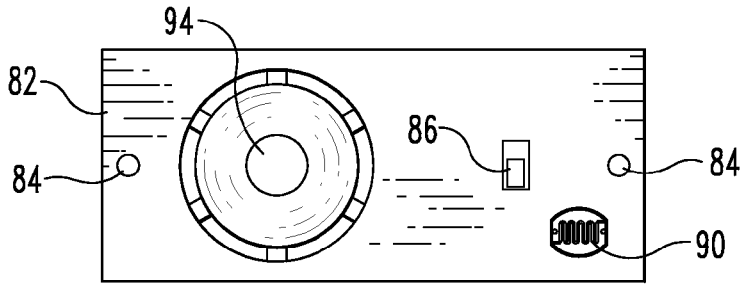
FIG. 10 is a top view of the support panel.
Figure 11:
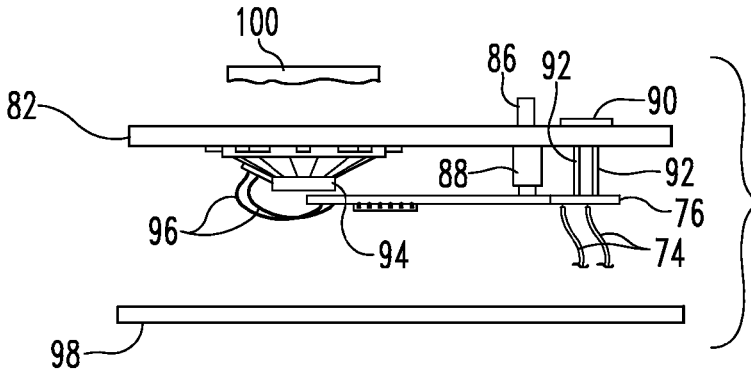
FIG. 11 is a side view of the support panel.

As can be seen in FIGS. 8 and 9, lower housing includes two support posts 78 each having a smaller diameter cylindrical projection 80 on their upper ends. A support panel 82 having two apertures 84 which mate with projections 80 is mounted on support posts 78. Support panel 82 is formed by injection molding a polymeric material and is secured to posts 78 with adhesive in the illustrated embodiment.

Printed circuit board 76 is mounted on support panel 82. Also mounted on support panel 82 is a switch 86 having a housing 88, a photodetector 90 with wire leads 92 and a small speaker 94. Wires 96 provide electrical communication between printed circuit board 76 and speaker 94. During assembly of movement 24, speaker 94, photodetector 90 and switch 86 are secured to panel 82 and are conductively engaged with printed circuit board 76. The engagement of printed circuit board 76 with leads 92 and switch 86 mounts the printed circuit board 76 to panel 82. Wiring 74 from battery cavity 66 is also conductively engaged with printed circuit board 76 before securing panel 82 to lower housing 62. A rectangular piece of foam 98 is placed within lower housing 62 between circuit board 76 and battery cavity 66 to protect the printed circuit board 76 before securing panel 82 to posts 78. A circular piece of foam 100 is positioned above speaker 94 and then upper cap 63 is secured to lower housing 62 to enclose support panel 82 within lower housing 62.

Figure 3:
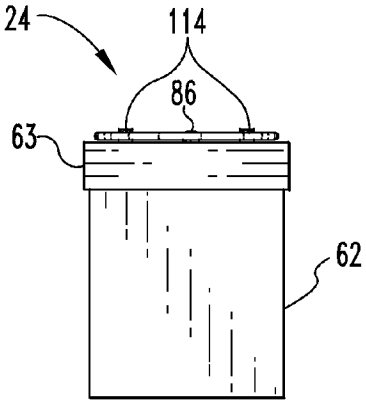
FIG. 3 is an end view of the interchangeable movement.
Figure 2:
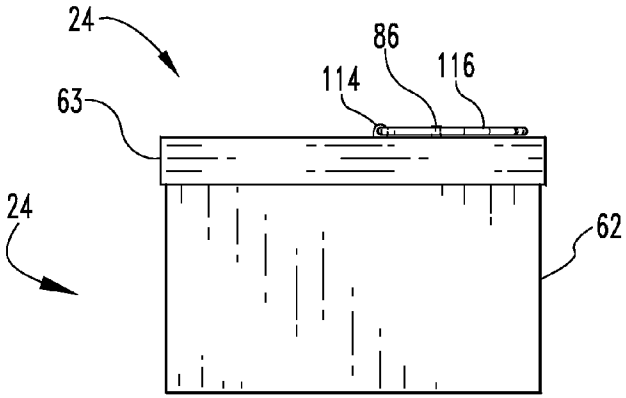
FIG. 2 is a side view of an interchangeable movement.
Figure 6:
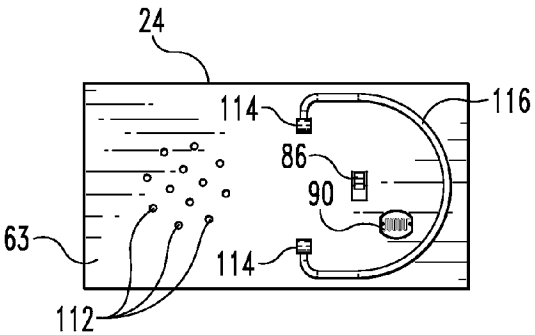
FIG. 6 is a top view of the interchangeable movement.
Figure 5:
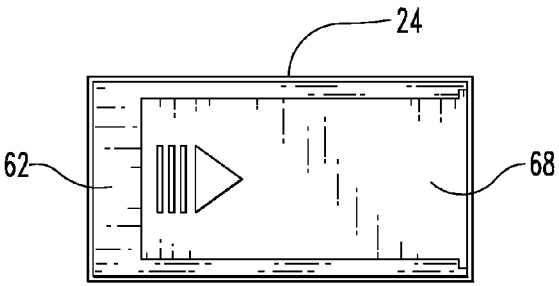
FIG. 5 is a bottom view of the interchangeable movement.

Upper cap 63 is formed by injection molding a polymeric material and has its exterior surface covered in black velvet to match the interior of music box 22. As best seen in FIG. 9, lower housing 62 has a thin-walled projection 102 along the inner perimeter of its upper edge which thereby forms a shoulder along its upper edge. Upper cap 63 has a downwardly projecting lip 104 along its outer perimeter and four downwardly projecting tabs 106 spaced inwardly from lip 104. Thin-walled projection 102 fits snugly between lip 104 and tabs 106 and this friction fit, together with an adhesive, secures cap 63 to lower housing 62. Cap 63 includes a slot 108 through which switch 86 projects and an opening 110 in which photodetector 90 is received. A plurality of small holes 112 are located above speaker 94 to allow for the communication of sound waves. The upper surface of cap 63 includes two projections 114 which pivotally receive the ends of a wire handle 116. FIGS. 2 and 3 illustrate wire handle 116 in a down position while FIG. 4 shows wire handle 116 in an extended position that allows movement 24 to be easily inserted and removed from compartment 54.

When movement 24 is positioned in compartment 54, it is only cap 63 which is exposed to view when lid 28 is in an open position, the remainder of movement 24 is hidden from view. In the illustrated embodiment, photodetector 90, speaker holes 112 and handle 116 are all disposed on cap 63 such that these items are all exposed to view when lid 28 is open and thereby prevents the impairment of the functionality of these items. Switch 86 is also advantageously disposed on cap 63 such that it is exposed to view when lid 28 is opened and movement 24 can be deactivated and reactivated without having to remove movement 24 from compartment 54.

The operation of movement 24 will now be discussed. Printed circuit board 76 includes control circuitry 118 and electronic memory 120. Batteries 64 provide the electrical power for movement 24. Switch 86 can be manually moved between two positions. In one position, movement 24 is deactivated and will not play a musical tune and in the second position movement 24 is activated and is capable of playing a musical tune. Control circuitry 118 controls the operation of movement 24. When movement 24 is activated and photodetector 90 detects light above a threshold value, control circuitry 118 is configured to activate speaker 94 and play a musical tune stored in electronic memory 120.

When movement 24 is located in music box 22 and is activated, the opening of lid 28 will allow light to strike photodetector 90 and thereby cause the musical tune stored in memory 120 to be played by speaker 94. When lid 28 is once again closed, lid 28 will limit the entry of light into the interior of music box 22 and substantially no light will strike photodetector 90 and the playing of the musical tune will cease. Of course, the movement of lid 28 to an open position also allows access to the interior compartments of the main body 26 while closing of lid 28 prevents access to the interior compartments. The provision of switch 86 allows the user to deactivate movement 24 and prevent the playing of the musical tune even though light is striking photodetector 90. This is particularly useful when movement 24 is still in the possession of the manufacturer or retailer or when the consumer has multiple movements 24 and it is desirable to prevent activation of the extra movements 24 which are not positioned within the music box 22.

In the illustrated embodiment, the audio data corresponding to the musical tune (or other recorded sounds) is recorded on the electronic memory 120 during manufacture and the consumer is not provided with a means for changing the musical tune played by movement 24. Alternative embodiments could include an interface, such as a USB plug, on movement 24 to allow the end consumer to record the original audio data written to electronic memory 120 or to selectively rewrite the data stored in electronic memory 120. Memory 120 would have to be rewritable to provide the consumer with the ability to rewrite audio data and thereby change the musical tune (or other recorded sounds) played by movement 24 at a later date. In still other embodiments, the movement could be provided to the consumer without any audio data recorded in memory 120, the consumer could then record audio data to the memory 120, for example, by activating a record function and speaking the desired audio which will then be played back from memory 120. In such an embodiment, the memory 120 could be both a consumer recorded and write-only memory. As mentioned above, the illustrated embodiment does not provide the consumer with the ability to record data to memory 120 and thereby allows the manufacturer to control the quality of the recording and reduce the manufacturing cost of movement 24.

While this invention has been described as having an exemplary design, the present invention may be further modified within the spirit and scope of this disclosure. This application is therefore intended to cover any variations, uses, or adaptations of the invention using its general principles.

What is claimed is:

1. A music box system, said system comprising:

a main body defining at least one compartment;

a lid operably secured to the main body and moveable between a closed position limiting access to the compartment and an open position permitting access to the compartment; and a movement having a housing and being removeably positionable within the compartment, the movement including control circuitry operably coupled with a power source, a speaker and data storage circuitry wherein the data storage circuitry is adapted to store audio data and the control circuitry is adapted to operate the speaker to play the audio data, and wherein the movement further includes a switch operably coupled with the control circuitry wherein the switch is operable to selective activate and deactivate the movement, and a photodetector operably coupled with the control circuitry wherein the control circuitry causes the speaker to play the audio data when the movement is activated and the photodetector detects light above a threshold value.

2. The music box system of claim 1 further comprising a second movement having a second housing and being removeably positionable within the compartment, the second movement including second control circuitry operably coupled with a second power source, a second speaker and second data storage circuitry wherein the second data storage circuitry is adapted to store second audio data and the second control circuitry is adapted to operate the second speaker to play the second audio data, and wherein the second movement further includes a second switch operably coupled with the second control circuitry wherein the second switch is operable to selective activate and deactivate the second movement, and a second photodetector operably coupled with the second control circuitry wherein the second control circuitry causes the second speaker to play the second audio data when the second movement is activated and the second photodetector detects light above a threshold value whereby the user of the music box may selectively exchange the movement and the second movement to position a desired one of the movement and the second movement within the main body.

3. The music box system of claim 1 wherein the movement includes a pivotal handle.

4. The music box system of claim 1 wherein the main body includes a plurality of compartments, one the plurality of compartments being shaped to substantially conform to and removably receive the movement.

5. The music box system of claim 1 wherein the lid is pivotally secured to the main body.

6. The music box system of claim 1 wherein when the lid is in the closed position substantially all light is prevented from entering the compartment.

7. A music box system comprising:

a main body defining at least one compartment;

a lid operably coupled with the main body and moveable between a closed position limiting access to the compartment and an open position permitting access to the compartment; and a plurality of movements selectively and exchangably positionable within the compartment, each of the movements having a housing and including control circuitry operably coupled with a power source, a speaker and data storage circuitry wherein the data storage circuitry is adapted to store audio data and the control circuitry is adapted to operate the speaker to play the audio data, and wherein each of the movements further includes a switch operably coupled with the control circuitry wherein the switch is operable to selective activate and deactivate the movement, and a photodetector operably coupled with the control circuitry wherein the control circuitry causes the speaker to play the audio data when the movement is activated and the photodetector detects light above a threshold value.

8. The music box system of claim 7 wherein each of the movements includes a pivotal handle.

9. The music box system of claim 7 wherein the main body includes a plurality of compartments, one the plurality of compartments being shaped to substantially conform to and removably receive a selected one of the movements.

10. The music box system of claim 7 wherein the lid is pivotally secured to the main body.

11. The music box system of claim 7 wherein the power source comprises at least one battery.

12. The music box system of claim 7 further comprising a plurality of main bodies, each of the plurality of movements having common exterior dimensions and each of the main bodies including a plurality of compartments, one the plurality of compartments being shaped to substantially conform to and removably receive a selected one of the movements.

13. A music box system comprising:

a main body defining a plurality of compartments;

a lid pivotally secured to the main body and moveable between a closed position limiting the entry of light and access to the compartments and an open position permitting access to the compartments;

a movement including control circuitry operably coupled with a power source, a speaker and data storage circuitry wherein the data storage circuitry is adapted to store audio data and the control circuitry is adapted to operate the speaker to play the audio data, and wherein the movement further includes a switch operably coupled with the control circuitry wherein the switch is operable to selective activate and deactivate the movement, and a photodetector operably coupled with the control circuitry wherein the control circuitry causes the speaker to play the audio data when the movement is activated and the photodetector detects light above a threshold value; and a movement housing, the control circuitry, power source, speaker and data storage circuitry, photo detector and switch all being supported on the housing, the housing being removably positionable within one of the plurality of compartments and wherein the housing further includes a pivotal handle to facilitate removal of the housing from the one compartment.

14. The music box system of claim 13 wherein the photodetector, switch and handle are all exposed when the housing is disposed in the one compartment and the lid is in the open position.

15. The music box system of claim 14 wherein the housing defines a plurality of openings, the speaker being mounted opposite the openings, the openings being exposed when the housing is disposed in the one compartment and the lid is in the open position.

16. The music box system of claim 15 wherein the power source comprises at least one battery and the housing has a removable cover, removal of the cover permitting access to the battery.

* * * * *